US008388099B2

(12) United States Patent
Murayama et al.

(10) Patent No.: US 8,388,099 B2
(45) Date of Patent: Mar. 5, 2013

(54) INK JET RECORDING HEAD

(75) Inventors: Hiroyuki Murayama, Kawasaki (JP); Yoshinori Tagawa, Yokohama (JP); Toshiaki Kurosu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 212 days.

(21) Appl. No.: 12/832,836

(22) Filed: Jul. 8, 2010

(65) Prior Publication Data

US 2011/0018933 A1 Jan. 27, 2011

(30) Foreign Application Priority Data

Jul. 22, 2009 (JP) ..... 2009-171168

(51) Int. Cl.
*B41J 2/015* (2006.01)

(52) U.S. Cl. ..... 347/20

(58) Field of Classification Search ..... None
See application file for complete search history.

(56) References Cited

U.S. PATENT DOCUMENTS 7,553,003 B2 6/2009 Takahashi et al.
2007/0035589 A1* 2/2007 Takahashi et al. ..... 347/68
2008/0259119 A1* 10/2008 Ikegame et al. ..... 347/40

FOREIGN PATENT DOCUMENTS

CN 1575999 A 2/2005
CN 1911664 A 2/2007
JP 2003-080717 A 3/2003
JP 2007-261169 A 10/2007

* cited by examiner

*Primary Examiner* — Matthew Luu
*Assistant Examiner* — Justin Seo
(74) *Attorney, Agent, or Firm* — Canon U.S.A., Inc., IP Division

(57) ABSTRACT

An ink jet recording head includes a coating resin layer including a plurality of ejection outlets for ejecting ink and a plurality of ink flow passages communicating with the plurality of ejection outlets; a substrate provided with an energy generating element for generating energy for ejecting the ink; and an adhesiveness-improving layer, provided between the coating resin layer and the substrate, for improving adhesiveness between the coating resin layer and the substrate. The adhesiveness-improving layer has a thickness so as to be larger at an end portion of the substrate than that at a portion other than the end portion.

4 Claims, 4 Drawing Sheets

INK JET RECORDING HEAD

FIELD OF THE INVENTION AND RELATED ART

The present invention relates to an ink jet recording head for effecting recording by ejecting ink toward a recording material (medium).

At present, as a method of effecting the recording on the recording material, an ink jet recording method using the ink jet recording head has been utilized widely. As an example of the ink jet recording head, a side shooter type ink jet recording head for ejecting ink droplets perpendicularly to a substrate has been disclosed (Japanese Laid-Open Patent Application (JP-A) 2007-261169).

The side shooter type ink jet recording head as the example of the conventional ink jet recording head has a constitution in which a coating resin layer including a plurality of ejection outlets is bonded onto the substrate. The substrate is provided with an ink supply port and at a bonding surface of the substrate where the coating resin layer is bonded on the substrate, an energy generating element is disposed at a position correspondingly to an associated ejection outlet of the coating resin layer on the substrate, an ink flow passage for establishing communication from the ink supply port of the substrate to the ejection outlet of the coating resin layer above the energy generating element is formed. The ink is supplied from the ink supply port to the ink flow passage and then is ejected from the ejection outlet by bubbles generated by the action of heat generation of the energy generating element to adhere to the recording material. In the ink jet recording head having such a constitution, at a central portion of the coating resin layer, a volume of the coating resin layer is smaller than that at an outer peripheral portion by a space in which the ejection outlets and the ink flow passage are provided.

On the other hand, in JP-A 2003-080717, an ink jet recording head in which the coating resin layer at the outer peripheral portion is formed in a thickness smaller than that at the central portion to decrease the volume of the coating resin layer at the outer peripheral portion has been disclosed.

In recent years, further output speed-up of a printer has been required. This is attributable to, as one of causes, a requirement to provide a high image droplet density with an improvement in processing speed of a computer or with size reduction in image droplet for outputting a higher definition image.

The requirement for the speed-up is further noticeable in a wide (large)-format printer or a printer connected to a network. The output speed-up of the printer is achievable by satisfaction of two requirements of an increase in number of generation of image droplets per hour, i.e., an improvement in image ejection frequency and an increase in number of the ejection outlets. Generally, the output speed-up of the printer is achieved by satisfying both of the two requirements.

However, the increase in number of the ejection outlets leads to elongation of the ink jet recording head. With the elongation of the ink jet recording head, it is clarified by various tests that a possibility of an occurrence of separation of the coating resin layer from the substrate at the outer peripheral portion of the coating resin layer is increased. That is, at an outside portion, of an area in which the ejection outlets and the ink flow passage are formed, which is the outer peripheral portion, a stress larger than that at the central portion of the coating resin layer is produced. For this reason, at the outer peripheral portion of the coating resin layer, frequency and degree of the occurrence of the separation of the coating resin layer from the substrate are further increased. Further, as a thickness of the coating resin layer is larger, i.e., as a volume of the coating resin layer is larger, the stress produced in the coating resin layer is larger, so that it is also clarified that the separation is more liable to occur.

In the above-described JP-A 2003-080717, the volume of the coating resin layer at the outer peripheral portion is made smaller than that at the central portion but a groove having a sawtooth edge is provided at the outer peripheral portion, so that processing is complicated. Further, at a portion further outside the groove, the coating resin layer is made thinner than that at an inside portion, so that there is a possibility of a lowering in strength of the ink jet recording head.

SUMMARY OF THE INVENTION

The present invention has been accomplished in view the above-described problems. A principal object of the present invention is to provide a highly reliable ink jet recording head capable of suppressing an occurrence of separation of a coating resin layer from a substrate.

According to an aspect of the present invention, there is provided an ink jet recording head comprising: a coating resin layer including a plurality of ejection outlets for ejecting ink and a plurality of ink flow passages communicating with the plurality of ejection outlets; a substrate provided with an energy generating element for generating energy for ejecting the ink; and an adhesiveness-improving layer, provided between the coating resin layer and the substrate, for improving adhesiveness between the coating resin layer and the substrate, wherein the adhesiveness-improving layer has a thickness so as to be larger at an end portion of the substrate than that at a portion other than the end portion.

These and other objects, features and advantages of the present invention will become more apparent upon a consideration of the following description of the preferred embodiments of the present invention taken in conjunction with the accompanying drawings.

According to the present invention, it is possible to suppress the occurrence of the separation of the coating resin layer, so that the reliability of the ink jet recording head can be enhanced.

DESCRIPTION OF THE PREFERRED EMBODIMENTS

Figure 1:
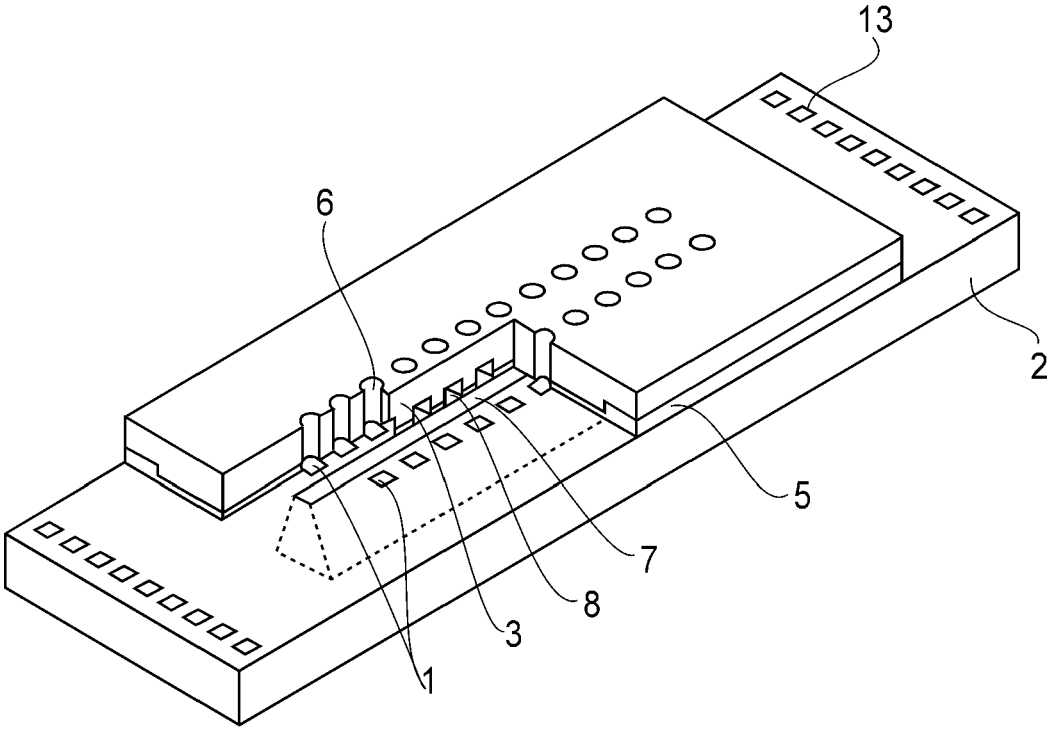
FIG. 1 is a schematic perspective view of an ink jet recording head in First Embodiment according to the present invention.

Hereinbelow, with reference to the drawings, embodiments of the present invention will be described. Incidentally, constituent elements having the same functions are represented by the same reference numerals and can be omitted from description thereof.

First Embodiment

FIG. 1 is a schematic perspective view of an ink jet recording head in First Embodiment according to the present invention. Incidentally, a part of a coating resin layer 3 is omitted so that an inner structure can be easily understood.

Figure 2:
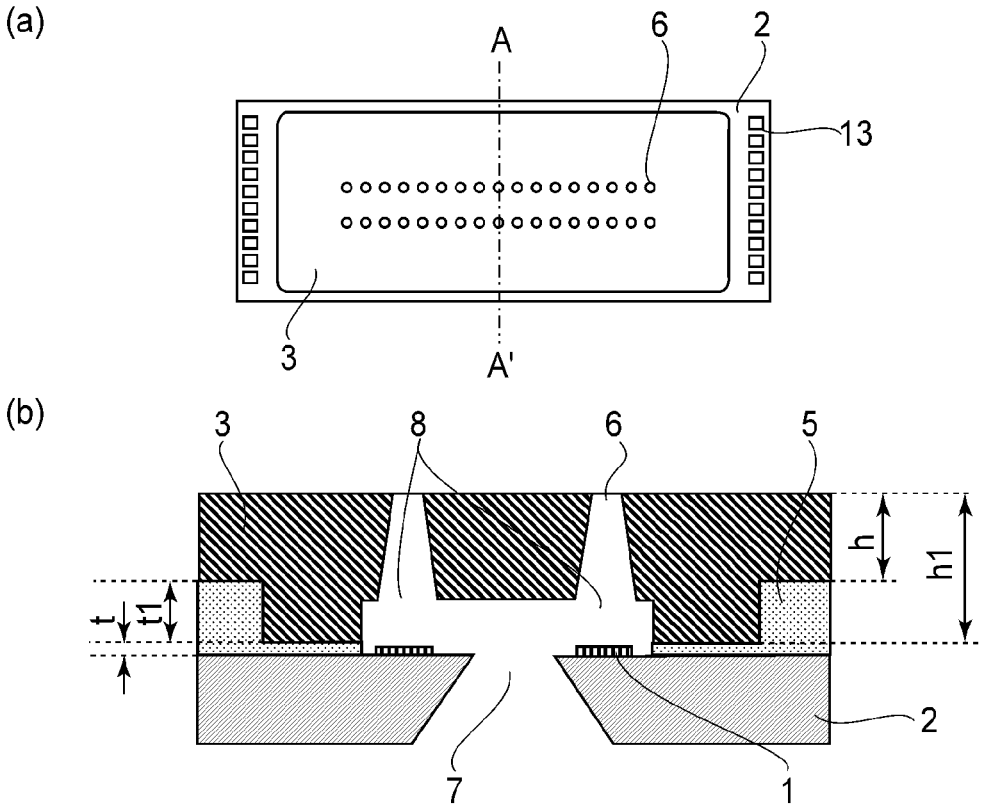
FIGS. 2(*a*) and 2(*b*) are schematic views of the ink jet recording head shown in FIG. 1, wherein FIG. 2(*a*) is a top plan view and FIG. 2(*b*) is a sectional view taken along A-A' line indicated in FIG. 2(*a*).

This ink jet recording head is formed by arranging energy generating elements in two parallel lines with a predetermined pitch and includes a substrate 2 on which contact pads 13 for establishing electrical connection to an external device. The substrate 2 is provided with an ink supply port 7 which opens between the two parallel lines of the energy generating elements 1. On the substrate 2, an adhesiveness-improving layer 5 and a coating resin layer 3 in which ejection outlets 6 each opening above an associated energy generating element 1 and ink flow passages each establishing communication from the ink supply port 7 to the ejection outlets 6 are formed are laminated. FIG. 2(*a*) is a top plan view of the ink jet recording head of FIG. 1. FIG. 2(*b*) is a sectional view of the ink jet recording head taken along A-A' line indicated in FIG. 2(*a*). In this embodiment, as a material for the adhesiveness-improving layer 5, thermoplastic polyether amide (trade name "HL-1200" mfd. by Hitachi Chemical Co., Ltd.) was used. This material is commercially available in a state of a solution in which the thermoplastic polyester amide is dissolved in a solvent. The adhesiveness-improving layer 5 is formed by applying such a solution of the thermoplastic polyether amide onto the surface of the substrate 2 of silicon (Si) by spin coating or the like and thereon, the coating resin layer 3 is formed. As the thermoplastic resin material for forming the adhesiveness-improving layer 5, in addition to the polyether amide resin, it is possible to apply polyether amide imide resin, polyimide resin, and the like. As described above, a stress generated in the coating resin layer 3 varies depending on a thickness of the coating resin layer 3. Specifically, with a thicker coating resin layer 3, the stress generated in the coating resin layer 3 becomes larger. In the conventional ink jet recording head, due to this stress, there is a possibility of an occurrence of separation between the coating resin layer 3 and the substrate 2, so that reliability of the ink jet recording head is impaired in some cases.

In view of this problem, in this embodiment, the adhesiveness-improving layer 5 is provided between the coating resin layer 3 and the substrate 2 so that the thickness of the coating resin layer 3 at an outer peripheral portion is smaller than that at a portion other than the outer peripheral portion. Hereinafter, description will be made in detail.

In the ink jet recording head in this embodiment, as shown in FIG. 2(*b*), the adhesiveness-improving layer 5 is disposed between the substrate 2 and the coating resin layer 3. A surface of the adhesiveness-improving layer 5 opposite from a surface of the adhesiveness-improving layer 5 contacting the substrate 2 constitutes a stepped portion including separated flat surface sections. The adhesiveness-improving layer 5 has a thickness t+t1 at the outer peripheral portion and has a thickness t at a central portion (inside the outer peripheral portion). When t1>0, the thickness of the adhesiveness-improving layer 5 at the outer peripheral portion is larger than that at the central portion, so that a height (thickness) h of the coating resin layer 3 at the outer peripheral portion is smaller than a height (thickness) h1 of the coating resin layer 3 at the central portion. Therefore, the stress generated in the coating resin layer 3 at the outer peripheral portion can be made smaller than that at the central portion. That is, the coating resin layer 3 in the present invention has the height h (<h1) at the outer peripheral portion and thus the volume of the coating resin layer 3 at the outer peripheral portion is smaller than that at the central portion, so that the stress generated in the coating resin layer 3 at the outer peripheral portion can be made smaller than that at the central portion. In other words, by providing the adhesiveness-improving layer 5 thicker at the outer peripheral portion than that at the central portion, the stress can be distributed to the coating resin layer 3 and the adhesiveness-improving layer 5. As a result, the stress in the coating resin layer 3 at the outer peripheral portion is smaller than that in the conventional coating resin layer at the outer peripheral portion. Therefore, it is possible to suppress not only separation between the coating resin layer 3 and the adhesiveness-improving layer 5 but also separation between the adhesiveness-improving layer 5 and the substrate 2.

Further, in this embodiment, the sum of the thickness of the adhesiveness-improving layer 5 and the thickness of the coating resin layer 3 at the outer peripheral portion is made substantially equal to that at the central portion. Therefore, also in an outer peripheral area of the substrate 2, a lowering in strength of the recording head can be suppressed. Further, the surface sections of the stepped portion of the adhesiveness-improving layer 5 are flat, so that the height h of the coating resin layer 3 at the outer peripheral portion is determined by the thickness t+t1 of the adhesiveness-improving layer 5 at the outer peripheral portion. In this embodiment, an inside height h1 of the coating resin layer 3 is about 35 μm to about 75 μm, and the height h of the coating resin layer 3 at the outer peripheral portion is about 17 μm to about 37 μm. In this case, h1/h≧2 may desirably be satisfied. Further, the height h of the coating resin layer 3 at the outer peripheral portion is not limited to the above range but may only be required that the separation between the coating resin layer 3 and the adhesiveness-improving layer 5 at the outer peripheral portion is not caused at the height h.

Figure 3:
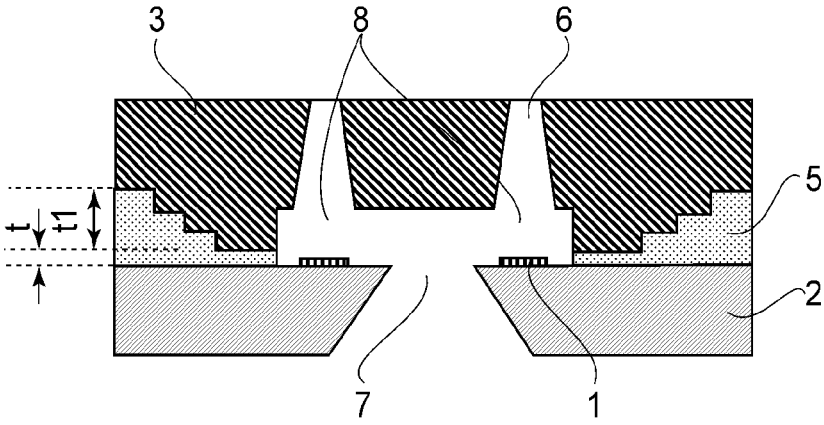
FIG. 3 is a sectional view showing a structure of the ink jet recording head shown in FIG. 1, in which the number of steps in a stepped portion of an adhesiveness-improving layer of the ink jet recording head is increased.

Further, in this embodiment, the adhesiveness-improving layer 5 is provided so as to have a single-level portion (stepped portion) having the thickness (height) t+t1 at the outer peripheral portion but may also be provided so as to have a stepped portion at two or more levels at the outer peripheral portion. That is, as shown in FIG. 3, the adhesiveness-improving layer 5 may also be formed to have a plurality of steps so that the thickness (height) thereof is stepwisely decreased from t1+t at the outer peripheral portion to t at the inside portion. However, in this case, it is preferable that the thickness of the outermost step portion is maximum. By employing such a constitution, the height h of the coating resin layer 3 at the outermost peripheral portion can be made minimum, so that the stress generated in the coating resin layer 3 at the outer peripheral portion can be further decreased.

As described above, when the stepped portion (including the plurality of step portions) is formed so that the thickness of the adhesiveness-improving layer 5 is stepwisely decreased from the outside toward the inside, the thickness of the coating resin layer 3 is stepwisely decreased from the inside toward the outside (outer peripheral portion). As a result, the stress generated in the coating resin layer 3 at the outer peripheral portion can be distributed depending on the thickness, so that a separation-preventing effect can be further enhanced.

Next, an example of a production process of the ink jet recording head in this embodiment will be described with reference to FIGS. 4(*a*) to 4(*f*).

Figure 4:
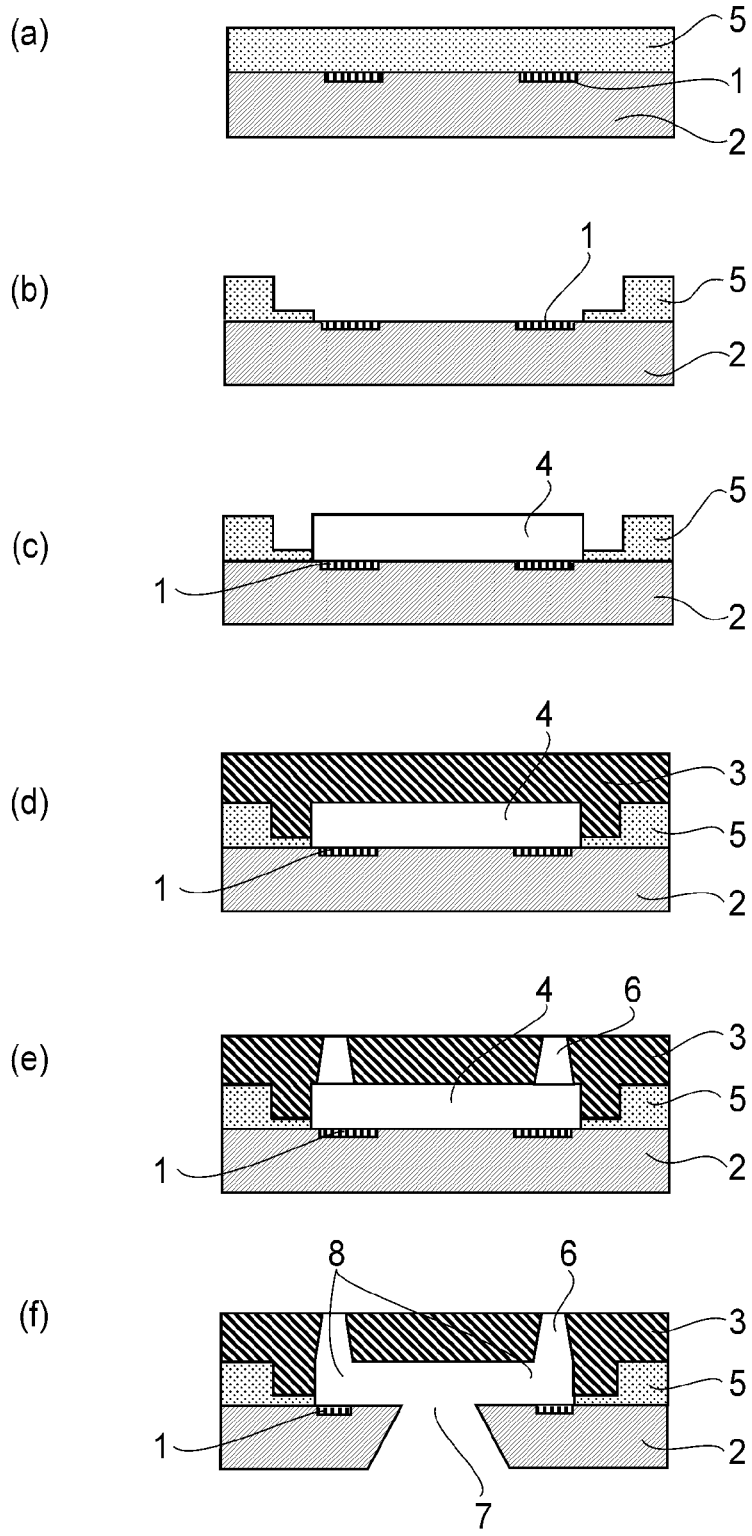
FIGS. 4(*a*) to 4(*f*) are sectional views for illustrating production steps of the ink jet recording head shown in FIG. 1.

As shown in FIG. 4(*a*), on the substrate 2 including the energy generating elements 1, the adhesiveness-improving layer 5 is formed. Then, as shown in FIG. 4(*b*), the adhesiveness-improving layer 5 is subjected to patterning so as to have a shape along a pattern based on which an ink flow passage 8 is to be formed thereafter. As a patterning method of the adhesiveness-improving layer 5, e.g., an outer peripheral area including portions different in thickness is formed by subjecting the adhesiveness-improving layer 5 formed on the entire surface of the substrate 2 in the thickness t+t1 to a process of a nanoimprint technique. Alternatively, the outer peripheral area can also be formed by subjecting the adhesiveness-improving layer 5 to half etching. Next, as shown in FIG. 4(*c*), a soluble resin layer 4 is formed. The soluble resin layer 4 is formed in a pattern constituting the ink flow passage 8. The soluble resin layer 4 is, e.g., formed by lamination of a dry film or application of a resist solution by spin coating or the like and then is subjected to patterning through exposure to, e.g., ultraviolet (UV) rays (such as deep-UV light) and through development and the like. In a specific example, the soluble resin layer 4 is formed by applying a solution of polymethyl isopropenyl ketone ("ODUR-1010" mfd. by TOKYO OHKA KOGYO CO., LTD.) by spin coating and then by drying the solution. Thereafter, the soluble resin layer 4 is subjected to patterning through the exposure to deep-UV light and through the development.

Then, as shown in FIG. 4(*d*), on the soluble resin layer 4, the coating resin layer 3 of epoxy resin is formed. Then, as shown in FIG. 4(*e*), the coating resin layer 3 is subjected to, e.g., exposure to the UV rays (deep-UV light) and subjected to the development, so that a pattern of the ejection outlets 6 is formed. Next, as shown in FIG. 4(*f*), the ink supply port 7 is formed by wet etching using an alkaline solution or the like or by dry etching and then the soluble resin layer 4 is removed. Thereafter, a resultant structure is subjected to thermal curing, so that the ink jet recording head is finished.

As described above, according to this embodiment, the thickness of the coating resin layer 3 at the outer peripheral portion is made smaller than that at the central portion by providing the adhesiveness-improving layer 5 between the coating resin layer 3 and the substrate 2, so that the stress generated in the coating resin layer 3 at the outer peripheral portion can be decreased and thus the separation of the coating resin layer 3 at the outer peripheral portion can be suppressed. Further, the surface of the coating resin layer 3 on a side where the ejection outlets 6 are provided is not provided with no stepped portion and therefore can be a flat surface. Further, in this embodiment, as shown in FIG. 1, a constitution in which the thickness of the coating resin layer 3 is decreased at end portions of the coating resin layer 3 with respect to a widthwise direction of the substrate 2 is described. This is because the volume of the conventional coating resin layer in the area (at the end portions) is large and therefore, particularly, an influence of separation of the coating resin layer from the substrate is large. However, the present invention is not limited to the constitution described above but may also employ a constitution for decreasing the thickness of the coating resin layer 3 not only at the end portions with respect to the widthwise direction of the substrate 2 but also at end portions with respect to a longitudinal direction of the substrate 2, i.e., at the entire periphery of the coating resin layer 3.

Second Embodiment

Figure 5:
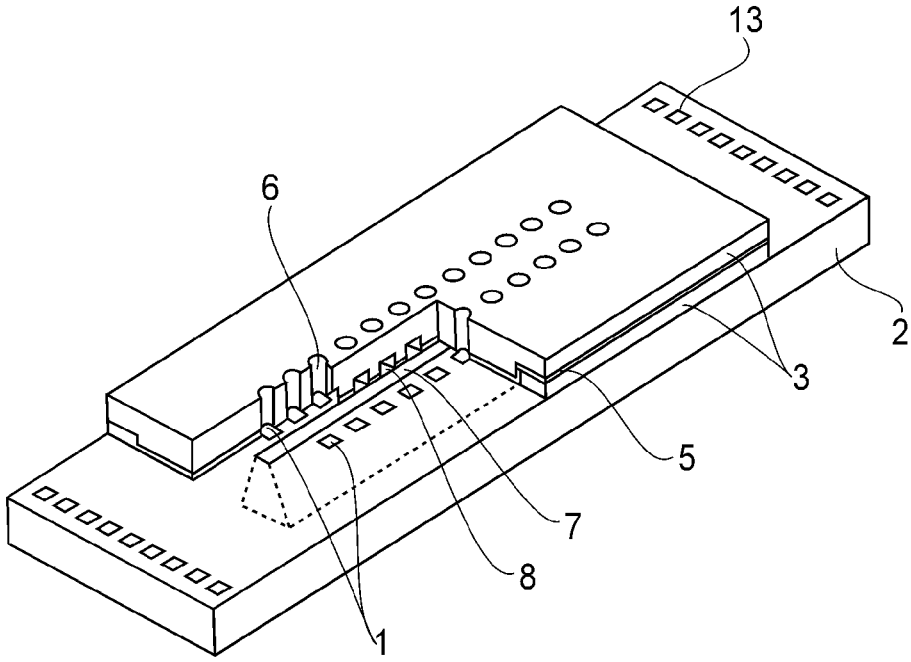
FIG. 5 is a schematic perspective view of an ink jet recording head in Second Embodiment according to the present invention.
Figure 6:
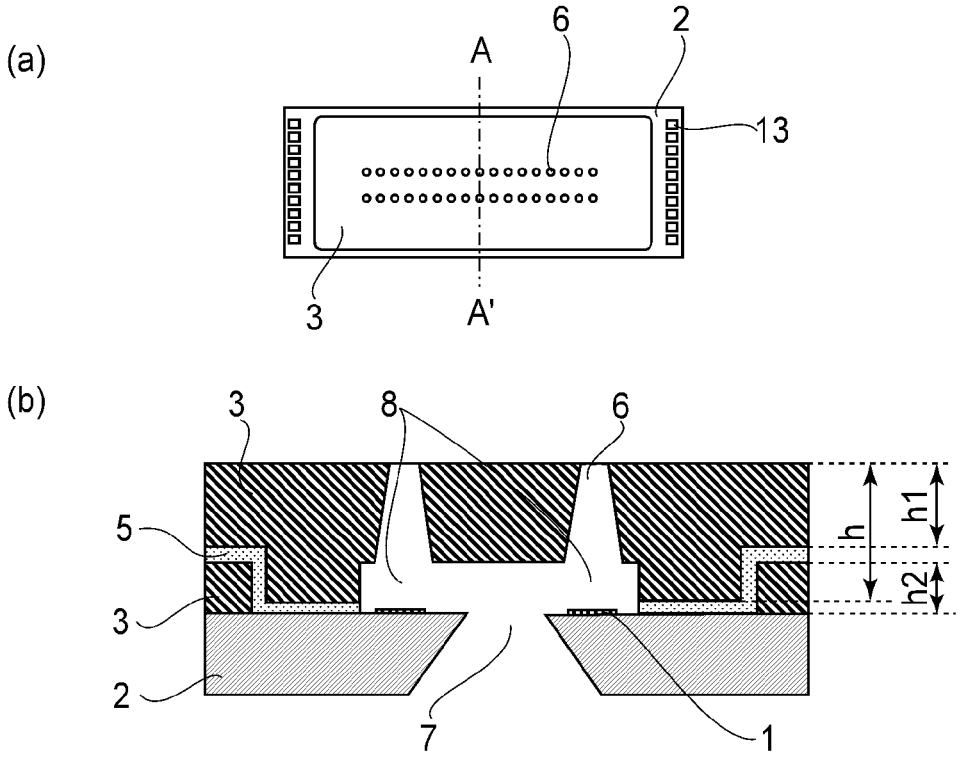
FIGS. 6(*a*) and 6(*b*) are schematic views of the ink jet recording head shown in FIG. 5, wherein FIG. 6(*a*) is a top plan view and FIG. 6(*b*) is a sectional view taken along A-A' line indicated in FIG. 6(*a*).

FIG. 5 is a schematic perspective view of an ink jet recording head in First Embodiment according to the present invention. Incidentally, a part of an upper side layer of the substrate 2 is omitted so that an inner structure can be easily understood. FIG. 6 is a top plan view of the ink jet recording head of FIG. 5, and FIG. 6(*b*) is a sectional view of the ink jet recording head taken along A-A' line indicated in FIG. 6(*a*).

In First Embodiment, the adhesiveness-improving layer 5 was provided between the substrate 2 and the coating resin layer 3 and by the presence of this adhesiveness-improving layer 5, the thickness of the coating resin layer 3 at the outer peripheral portion was made smaller than that at the inside of the outer peripheral portion. On the other hand, in this embodiment, at the outer peripheral portion of the coating resin layer 3, the adhesiveness-improving layer 5 is provided so as to be sandwiched between two portions of the coating resin layer 3. That is, at the outer peripheral portion of the adhesiveness-improving layer 5, the adhesiveness-improving layer 5 is disposed so as to divide the coating resin layer 3 into the two portions with respect to a thickness direction of the coating resin layer 3. Hereinafter, this constitution will be described more specifically. Incidentally, the constitution of the ink jet recording head in this embodiment is similar to that of the ink jet recording head in First Embodiment except that the outer peripheral portion of the adhesiveness-improving layer 5 divides the outer peripheral portion of the coating resin layer 3 into the two portions with respect to the thickness present direction of the coating resin layer 3. Therefore, detailed description on points similar to those in First Embodiment will be omitted and the constituent elements identical to those in First Embodiment will be described by using the same reference numerals or symbols used in First Embodiment.

The adhesiveness-improving layer 5 is a thin layer having a stepwise shape and is disposed so as to be sandwiched between the substrate 2 and the coating resin layer 3 at the central portion of the substrate 2. Further, the adhesiveness-improving layer 5 is spaced from the surface of the substrate 2 at the outer peripheral portion and enters an inner portion of the outer peripheral portion of the coating resin layer 3, thus constituting a layer by which the outer peripheral portion of the coating resin layer 3 is divided into the two portions with respect to the thickness direction of the coating resin layer 3. By the presence of this adhesiveness-improving layer 5, the coating resin layer 3 is a single layer having the height (thickness) h at the central portion but is divided into the upper side layer having the height h1 smaller than the height h and a lower side layer having the height h2 smaller than the height h. The stress generated in the coating resin layer 3 divided by the adhesiveness-improving layer 5 is also divided into two stress values depending on associated ones of the heights of the upper side layer and the lower side layer, so that the stress is smaller than that in the conventional shape and therefore the separation can be suppressed. Even when the separation occurs between the substrate 2 and the lower side layer of the coating resin layer 3 divided at the outer peripheral portion, the thickness of the lower side layer under the adhesiveness-improving layer 5 is small and for this reason, the stress generated in the lower side layer under the adhesiveness-improving layer 5 is small, so that the separation between the adhesiveness-improving layer 5 and the substrate 2 does not occur. In this embodiment, the height h1 of the upper side layer of the coating resin layer 3 on the adhesiveness-improving layer 5 at the outer peripheral portion is similar to that in Embodiment 1, specifically about 20 μm to about 40 μm.

Incidentally, in the above description, the constitution in which the adhesiveness-improving layer 5 has a stepped portion so that a higher (single) step divides the outer peripheral portion of the coating resin layer 3 into the upper side layer and the lower side layer with respect to the thickness direction of the coating resin layer 3 is employed. In addition thereto, it is also possible to employ a constitution in which the adhesiveness-improving layer 5 is formed in a stepwise shape including a plurality of step portions so that the height (thickness) of the adhesiveness-improving layer 5 is stepwisely increased from the central portion toward the outer peripheral portion to divide the coating resin layer 3 into the upper side layer and the lower side layer with respect to the thickness direction of the coating resin layer 3.

In the above description, numerical values and the like are merely examples and therefore the present invention is not limited to these numerical values.

Next, an example of the production process of the ink jet recording head in this embodiment will be described. After the coating resin layer 3 is formed on the substrate 2 including the energy generating elements 1, the portion except the lower side layer of the coating resin layer 3 is removed at the outer peripheral portion. Then, the substrate 2 and the entire lower side layer of the coating resin layer 3 at the outer peripheral portion are covered with the adhesiveness-improving layer 5, and the adhesiveness-improving layer 5 is subjected to patterning so as to have a shape along a pattern constituting the ink flow passage 8 to be formed thereafter. Next, the soluble resin layer 4 is formed in a pattern constituting the ink flow passage 8 and then the entire surface thereof is covered with the coating resin layer 3. This coating resin layer 3 constitutes the upper side layer at the outer peripheral portion. Next, the ejection outlets 6 are formed but its step and subsequent steps are identical to those described in First Embodiment, thus being omitted from explanation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 171168/2009 filed Jul. 22, 2009, which is hereby incorporated by reference.

What is claimed is:

1. An ink jet recording head comprising:

a resin layer including a plurality of ejection outlets for ejecting ink and a plurality of ink flow passages communicating with the plurality of ejection outlets;

a substrate, on which an energy generating element for generating energy for ejecting the ink, is placed; and an adhesiveness-improving layer, provided between said resin layer and said substrate, for improving adhesiveness between said resin layer and said substrate, wherein said adhesiveness-improving layer has a thickness so as to be larger at an end portion of said substrate than that at a portion other than the end portion.

2. A head according to claim 1, wherein the end portion is a substrate end portion with respect to a widthwise direction of said substrate.

3. A head according to claim 1, wherein said adhesiveness-improving layer is stepwisely thicker from a central portion of said substrate toward the end portion of said substrate.

4. A head according to claim 1, wherein a sum of a thickness of said adhesiveness-improving layer and a thickness of said resin layer at the end portion of said substrate is substantially equal to that at a central portion of said substrate.

* * * * *